United States Patent [19]

Errecart

[11] Patent Number: 4,658,863

[45] Date of Patent: Apr. 21, 1987

[54] SCREEN FOR PAPERMAKING PRESS

[75] Inventor: Jean-Louis Errecart, Boulieu-Les-Annonay, France

[73] Assignee: Binet Feutres S. A., Annonay, France

[21] Appl. No.: 838,913

[22] Filed: Mar. 12, 1986

[30] Foreign Application Priority Data

Mar. 12, 1985 [FR] France ..... 85 04062

[51] Int. Cl.[4] ..... D03D 3/04

[52] U.S. Cl. ..... 139/383 A; 24/33 P

[58] Field of Search ..... 139/383 A, 425 A; 162/DIG. 1, 348, 349; 24/31 C, 31 H, 33 R, 33 P, 38

[56] References Cited

U.S. PATENT DOCUMENTS

| | | | |
|---|---|---|---|
| 4,095,622 | 6/1978 | MacBean | 139/383 A |
| 4,206,787 | 6/1980 | Strandly | 139/383 A |
| 4,438,789 | 3/1984 | MacBean | 139/383 A |

FOREIGN PATENT DOCUMENTS

| | | | |
|---|---|---|---|
| 982682 | 2/1965 | United Kingdom | 139/383 A |

*Primary Examiner*—Henry S. Jaudon

*Attorney, Agent, or Firm*—Karl F. Ross; Herbert Dubno

[57] ABSTRACT

A papermaking screen has a pair of ends secured together at a joint and formed of a plurality of longitudinal warp filaments having warp ends secured together at the joint and weft filaments transversely woven with the warp filaments. One end of each warp filament is formed with a short loop extending longitudinally a short distance past the weft filaments and the opposite end is formed with a long loop extending longitudinally a long distance past the weft filaments longitudinally in line with but longitudinally spaced from the respective short loop. A first portion of the warp filaments has its long loops projecting from one end of the belt and a second portion has its long loops projecting from the opposite end of the belt between the short loops of the first portion. A first joint rod passes transversely through all of the long loops but only through the short loops of the first portion and a second joint rod passes transversely through all of the long loops but only through the short loops of the second portion. The short distance is equal to about half of the long distance.

5 Claims, 14 Drawing Figures

FIG. 5
PRIOR ART
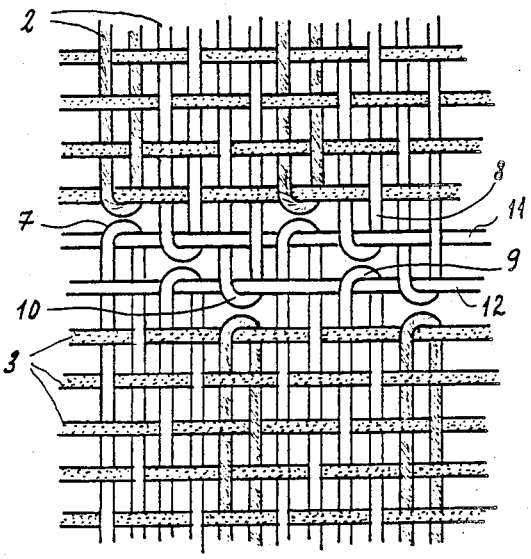
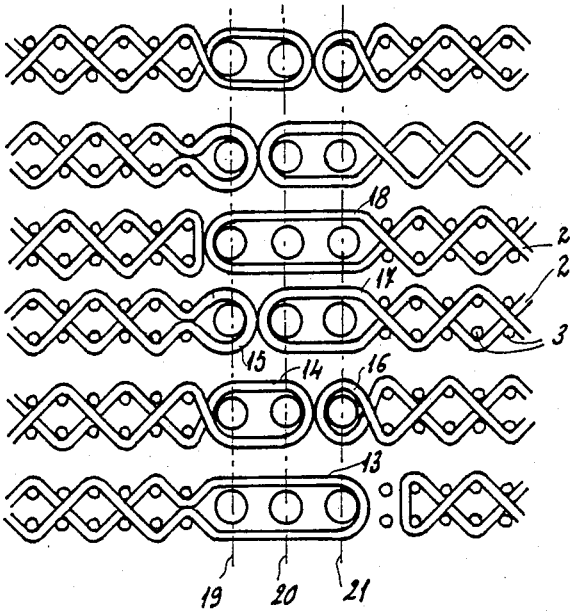
FIG. 8A
FIG. 8B
FIG. 8C
FIG. 8D
FIG. 8E
FIG. 8F
FIG. 9
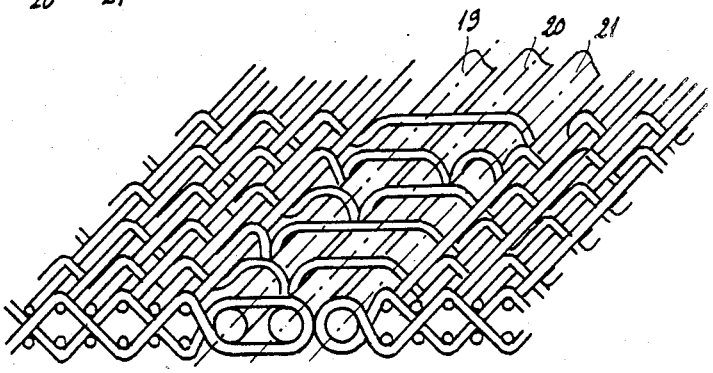

SCREEN FOR PAPERMAKING PRESS

FIELD OF THE INVENTION

The present invention relates to an endless felt or screen used in a papermaking apparatus. More particularly this invention concerns the screen used in the dewatering and forming press of such an apparatus.

BACKGROUND OF THE INVENTION

In the manufacture of paper an extremely dilute mixture of fibers, water, and some additives is poured on an endless screen that is of such fine mesh size that the liquid phase can be sucked and pressed through it, leaving a uniform layer of fibers on the screen. When the layer of fibers and the screen pass between high-pressure dewatering rollers the screen is subjected to enormous (=/>100 bar) pressures transversely and it is also subjected to fairly considerable longitudinal tensions since it must be held taut and free of vibration.

Such a screen is made of a strip of material whose ends are joined. Thus in use they are endless, while at the same time they can be threaded through the machines when they need to be replaced. This joint must provide the solid connection needed to resist longitudinal tension, must permit the same runoff or runthrough of liquid as the rest of the screen, must present a surface like that of the rest of the screen, and must be relatively easy to open and close. In addition the mass of the screen should be about the same at the joint as anywhere else on the screen so that if heated dewatering and drying rollers are used the joint will not form a cold spot.

In one such system, one end of each warp filament is formed into a loop lying in a longitudinal plane perpendicular to the plane of the screen at the joint and these loops are interleaved. A joint rod extending parallel to the weft filaments engages through the interleaved loops. The opposite end of each warp filament terminates short of the respective looped end at the joint in longitudinal line with this looped end. Such an joint is fairly weak with regard to longitudinal forces since only half of the ends of the warp filaments are actually engaged at the joint. Thus at the joint the longitudinal resistance to breaking will be half that of the rest of the screen.

In the system of French Pat. No. 2,195,303 one end of each warp filament is formed with a long loop and the opposite end with a short loop. The ends are aligned with the long loop of each warp filament lying transversely against and longitudinally overlapping the short loop of the same warp wire, and two longitudinally spaced joint rods are fitted to the assembly, with the one rod going through the loops of half of the warp filaments and the other rod going through the loops of the other warp wires. Such an arrangement can withstand substantial longitudinal forces, but constitutes a dense spot that water cannot pass transversely through or longitudinally along as well as through and along the rest of the screen. Furthermore the joint region also constitutes a hard spot in the screen that can cause the dewatering press to mark the paper pressed against it.

In U.S. Pat. No. 4,095,622 the screen has warp filaments that are generally continuous over the belt. Long loops and short loops are formed here by the joining of two adjacent warp ends so that these loops all inherently lie in a plane mainly parallel to that of the screen. They can be interleaved and connected by two joint rods, an operation that requires meticulous twisting of the screen and working of the rods through the loops. Since each rod only traverses two-thirds of the loops, the joint is fairly weak and the crimp where they cross over these rods can damage the warp filaments.

OBJECTS OF THE INVENTION

It is therefore an object of the present invention to provide an improved papermaking screen.

Another object is the provision of an improved joint assembly for such a papermaking screen which overcomes the above-given disadvantages, that is which can resist longitudinal forces of great strength, that can be compressed at pressures of at least 100 bar without damage and with the same resistance as the rest of the screen, and that is easy to open and close when the screen is being changed.

SUMMARY OF THE INVENTION

A papermaking screen has a pair of ends secured together at a joint and formed of a plurality of longitudinal warp filaments having warp ends secured together at the joint and weft filaments transversely woven with the warp filaments. According to this invention one end of each warp filament is formed with a short loop extending longitudinally a short distance past the weft filaments and the opposite end is formed with a long loop extending longitudinally a long distance past the weft filaments longitudinally in line with but longitudinally spaced from the respective short loop. A first portion of the warp filaments has its long loops projecting from one end of the belt and a second portion has its long loops projecting from the opposite end of the belt between the short loops of the first portion. A first joint rod passes transversely through all of the long loops but only through the short loops of the first portion and a second joint rod passes transversely through all of the long loops but only through the short loops of the second portion. The short distance is equal to about half of the long distance.

In addition according to this invention one end of each warp filament of a third portion of the warp filaments is turned back and forms no loop past the weft filaments and the opposite end is formed with an extralong loop extending longitudinally three times the short distance past the weft filaments longitudinally in line with but longitudinally spaced from the respective short loop. Furthermore a third rod extends through all the extralong loops and through all of the short and long loops of the respective screen end.

In other words, according to this invention a joint assembly for a screen for pressing a wet paper mat has screen ends each provided with several sets of loops in a region free of weft filaments. Each end of the screen is formed with at least two sets of loops aligned warpwise with one another and this alignment is maintained by two different joint rods passing through the two loops formed by the two ends of the warp filaments so as to form a transversely and longitudinally open gap. The sets of loops aligned with one another are spread out over three such rods. Furthermore, each end of every warp filament forms a respective one of the loops.

With the system of this invention gaps are created that facilitate the longitudinal flow of water as well as the flow through the screen. The joint is not particularly harder at the joint, so that the paper is not marked by it.

DESCRIPTION OF THE DRAWING

The above and other features and advantages will become more readily apparent from the following, reference being made to the accompanying drawing in which:

FIGS. 1, 3, and 5 are top views of details of the joints of prior-art screens;

FIGS. 8A through 8F are longitudinal, that is warpwise, sections through the joint of this invention at successive adjacent filaments and FIG. 9 is a large-scale perspective view of a detail of the joint of this invention.

SPECIFIC DESCRIPTION

As seen in FIGS. 1, 3, 5, and 6, a papermaking screen is formed of longitudinal warp filaments 2 and transverse weft filaments 3 interleaved in a simple over-under weave therewith. Each warp filament 2 extends the full length of the screen, which before jointing into an annular belt is of long rectangular shape, and each warp filament 3 extends the screen's full width.

Figure 1:
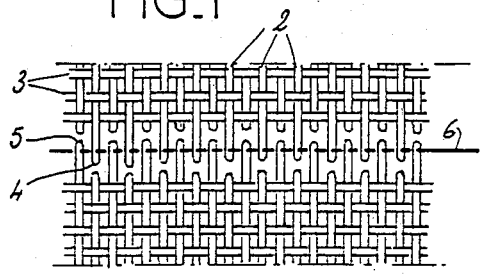
FIG. 1 PRIOR ART
Figure 2:
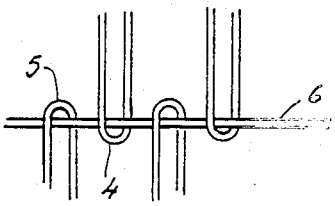
FIG. 2 PRIOR ART
FIGS. 2 and 4 are large-scale views of details of FIGS. 1 and 3, respectively.

In one prior-art system shown in FIGS. 1 and 2, one end of each warp filament is formed into a loop 4 or 5 lying in a longitudinal plane perpendicular to the plane of the screen at the joint and these loops 4 and 5 are interleaved. A joint rod 6 extending parallel to the weft filaments 3 engages through the interleaved loops. Such an arrangement has the main disadvantage that it is fairly weak, especially with regard to longitudinal forces since only half of the ends of its warp filaments 2 are actually engaged at the joint so that at maximum the longitudinal resistance to breaking will be half that of the rest of the screen.

Figure 3:
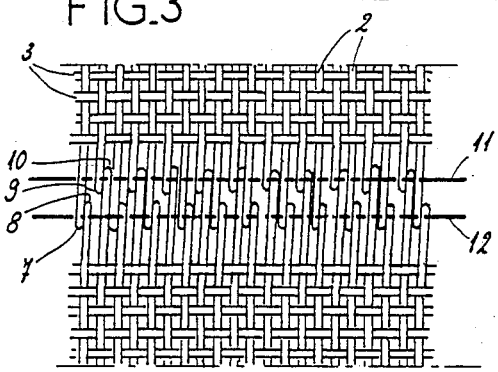
FIG. 3 PRIOR ART
Figure 4:
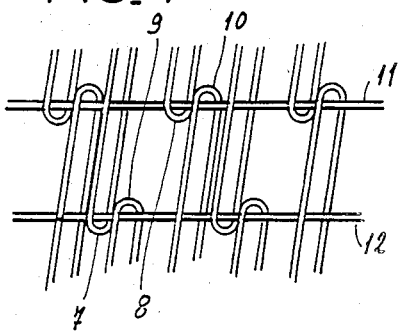
FIG. 4 PRIOR ART
Figure 6:
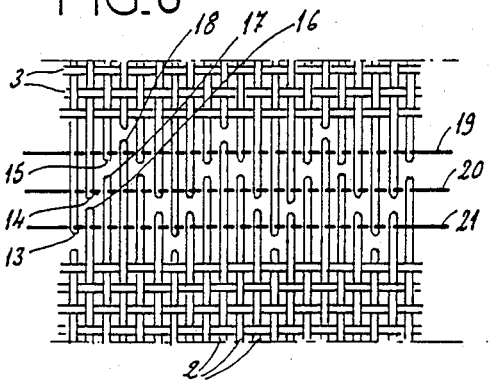
FIGS. 6 and 7 are views like FIGS. 1 and 2 of the screen according to this invention.

The system of FIGS. 3 and 4, which corresponds generally to that of French Pat. No. 2,195,303, has one end of each warp filament 2 formed with a long loop 7 or 10 and the opposite end with a short loop 8 or 9. The ends are aligned with each loop 7 and 10 lying transversely against and longitudinally overlapping the respective loops 8 and 9, and two longitudinally spaced joint rods 11 and 12 are fitted to the assembly, with the rod 11 going through the loops 9 and 10 of half of the warp filaments 3 and the rod 12 going through the loops 7 and 8 of the other half. Such an arrangement can withstand substantial longitudinal forces, but represents a dense spot that water cannot pass transversely through or longitudinally along as well as through and along the rest of the screen. Furthermore the joint region also constitutes a hard spot in the screen that can cause the dewatering press to mark the paper pressed against it.

In FIG. 5 a system corresponding generally to that of U.S. Pat. No. 4,095,622 is shown which has warp filaments that are generally continuous over the belt. Long loops 7 and 10 and short loops 8 and 9 are formed here by the joining of two adjacent warp ends so that these loops 7–10 all inherently lie in a plane mainly parallel to that of the screen. They can be interleaved and connected by two joint rods 11 and 12, an operation that requires meticulous twisting of the screen and working of the rods 11 and 12 through the loops. Since each rod 11 or 12 only traverses one-third of the loops, the joint is fairly weak and the crimp where they cross over these rods 11 and 12 can damage the warp filaments 2.

The system of the instant invention, as seen in FIGS. 6, 7, 8A–8F, and 9 has at each end of the screen, in a region devoid of weft filaments 3, several sets of loops 13, 14, 15, 16, 17, and 18 of different lengths formed by the warp filaments 2. Unlike the above-described prior-art systems, these sets of loops to not overlap transversely but are aligned, that is each warp filament's loop at one end is longitudinally aligned with the loop at its opposite end, but they still define passages for joint rods 19, 20, and 21.

Figure 7:
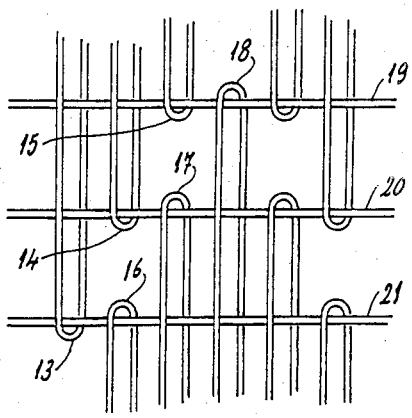

As best seen in FIG. 7 the loop 14 formed at one end of a warp filament 2 and the loop 16 formed at its opposite end are longitudinally aligned, unlike the prior-art systems. Similarly the loops 15 and 17 at the end of the same filament 2 are longitudinally aligned.

The passages intended to receive the rods 19, 20, and 21 are therefore not formed by two transversely aligned loops of the same warp filament, but by means of loops of different warp filaments, that is none of the warp filaments has both its ends looped over and pulling on the same rod 19, 20, or 21. The rod 19 passes through the sets of loops 15 and 18, the rod 20 through the set of loops 14 and 17, and the rod 21 through the set of the loops 13 and 16. The loops 14 and 16 formed at the two ends of the screen by the same warp filament are maintained aligned by two different joint rods 20 and 21. The loops 15 and 17 are similarly aligned by the rods 19 and 20. This alignment is best seen in FIG. 9 where the filaments are exactly aligned, avoiding the skewing of the loops as in FIG. 5.

Thus FIGS. 5 through 9 show how the loops at the ends form gaps facilitating flow of water under the press along the warp. The interstitial flow passages are maintained without distortion so as to avoid irregularities of thickness which could mark the paper being made.

According to a preferred embodiment of the invention all the warp filaments form loops at each of their ends.

The system of this invention leaves clearance that permits some twisting of the warp and tensioning of the screen in case of vibrations and provides the elasticity necessary to compensate for the shocks that inevitably come. Relative to the prior-art joint assemblies described in FIGS. 1 through 5, the joint of this invention is stronger by 66%, that is the longitudinal warpwise force necessary to break the belt at the joint is equal to 166% that necessary to similarly break a prior-art assembly.

Another important advantage of the instant invention is the ease with which it can be opened and closed for mounting in a press. The loops 15 and 18 for the rod 19 are aligned and this rod 19 slipped through them to start with, an operation that is quite easy because one is only working with a sixth of the loops. Then the loops 13 and 16 are aligned and the rod 21 inserted. The last rod 20 can be slipped into the loops 14 and 17 which will be automatically perfectly aligned by the two rods 19 and 21.

I claim:

1. In a papermaking screen having a pair of ends secured together at a joint and formed of a plurality of longitudinal warp filaments having warp ends secured together at the joint and weft filaments transversely woven with the warp filaments, the improvement wherein one end of each warp filament is formed with a short loop extending longitudinally a short distance past the weft filaments and the opposite end is formed with a long loop extending longitudinally a long distance past the weft filaments longitudinally in line with but longitudinally spaced from the respective short loop, a first portion of the warp filaments having its long loops projecting from one end of the belt and a second portion having its long loops projecting from the opposite end of the belt between the short loops of the first portion;

a first joint rod passes transversely through all of the long loops but only through the short loops of the first portion; and a second joint rod passes transversely through all of the long loops but only through the short loops of the second portion.

2. The improved papermaking screen defined in claim 1 wherein the short distance is equal to about half of the long distance.

3. The improved papermaking screen of claim 2 wherein one end of each warp filament of a third portion of the warp filaments is turned back and forms no loop, part the weft filaments and the opposite end is formed with an extralong loop extending longitudinally three times the short distance past the weft filaments longitudinally in line with but longitudinally spaced from the respective short loop; and a third rod extends through all the extralong loops and through all of the short and long loops of the respective screen end.

4. A joint assembly for a screen for pressing a wet paper mat, the screen having ends each provided with several sets of loops in a region free of weft filaments, each end of the screen being formed with at least two sets of loops aligned warpwise with one another, this alignment being maintained by two different joint rods passing through the two loops formed by the two ends of the warp filaments so as to form a transversely and longitudinally open gap, the sets of loops aligned with one another being spread out over three such rods.

5. The joint assembly defined in claim 4 wherein each end of every warp filament forms a respective one of the loops.

* * * * *